United States Patent [19]

Combs

[11] Patent Number: 5,016,301

[45] Date of Patent: May 21, 1991

[54] INFANT ROCKER/CRADLE

[76] Inventor: Mary A. Combs, 12328 W. Grand Pl., Morrison, Colo. 80465

[21] Appl. No.: 598,138

[22] Filed: Oct. 16, 1990

[51] Int. Cl.[5] ..... A47D 9/04

[52] U.S. Cl. ..... 5/105; 5/101; 5/102; 5/98.3

[58] Field of Search ..... 5/101, 1, 105, 108, 5/98.1, 98.3, 93.2, 93.1

[56] References Cited

U.S. PATENT DOCUMENTS

| | | | |
|---|---|---|---|
| 46,091 | 1/1865 | Eastman . | |
| 55,401 | 6/1866 | Warren | 5/105 |
| 100,925 | 3/1870 | Reynolds . | |
| 135,138 | 1/1873 | McNamara . | |
| 250,614 | 12/1881 | Wilbur et al. . | |
| 254,241 | 2/1882 | Sailor . | |
| 261,017 | 7/1882 | Menuez . | |
| 1,046,189 | 12/1912 | Houser . | |
| 1,368,145 | 2/1921 | Hauser . | |
| 1,722,408 | 7/1929 | Brabec . | |
| 2,036,157 | 3/1936 | Mansberger | 5/105 |
| 2,417,618 | 3/1947 | Scott | 5/105 |
| 2,553,862 | 5/1951 | Morris | 5/105 |
| 2,617,121 | 11/1952 | Chatlos . | |
| 2,696,691 | 12/1954 | Larsen . | |
| 2,988,358 | 6/1961 | Mills | 5/105 |
| 3,837,019 | 9/1974 | Hoff . | |
| 4,205,876 | 6/1980 | Cetina | 5/101 |

*Primary Examiner*—Michael F. Trettel
*Assistant Examiner*—F. Saether
*Attorney, Agent, or Firm*—Brian D. Smith

[57] ABSTRACT

An infant rocker/cradle is disclosed. The rocker/cradle includes a generally rectangular frame having two generally parallel, opposing and spaced sides which are joined to each other by two generally parallel, opposing and spaced ends which join the sides at generally right angles. Each side defines a first arcuate rocking edge which is parallel to that of the other side. In addition, each end defines a second arcuate rocking edge which is parallel to that of the other end. The first and second arcuate rocking edges are oriented with respect to each other so that they generally face opposite directions and are disposed at right angles with respect to each other. In addition, the rocker/cradle includes a firm but resilient hammock which is attached to the inner facing surfaces of the frames' ends and sides and which firmly supports an infant lying thereon.

12 Claims, 2 Drawing Sheets

INFANT ROCKER/CRADLE

TECHNICAL FIELD

The invention relates generally to infant cradles and rockers and more particularly to a device for both rocking and cradling an infant.

BACKGROUND ART

The prior art is replete with various types of infant cradles and cribs. U.S. Pat. Nos. 135,138 to McNamara; 250,614 to Wilbur, et al.; 254,241 to Sailor; 261,017 to Menuez; and 1,368,145 to Hauser disclose various infant cradles which are foldable or collapsible in one respect or another. U.S. Pat. Nos. 46,091 to Eastman; 1,046,189 to Hauser; and 2,617,121 to Chatlos disclose infant cradles which can be converted into stable cribs. The Chatlos patent is of interest in that it is reversible in the sense that it functions as a stable crib in one position and when turned upside down functions as a cradle. U.S. Pat. No. 3,837,019 to Hoff discloses a modular cradle-like structure having a frame comprised of tubular members and socketed couplings which can be stored in a minimum of space when it is disassembled.

U.S. Pat. No. 1,722,408 to Brabec discloses a combined rocker and bed for children. This device differs from the aforementioned devices in that it rocks an infant in the lengthwise direction of the infant's body, i.e. from head to toe. This type of device will be referred to herein as a "rocker". The previously mentioned devices which rock an infant laterally from side to side will be referred to herein as a "cradle" and this type of rocking motion will be sometimes referred to herein as "cradling".

While the aforementioned patents disclose various cradles and rockers for rocking and cradling an infant, none has the capability of both rocking and cradling an infant, i.e. cradling an infant laterally, from side to side and rocking an infant lengthwise from head to toe.

DISCLOSURE OF THE INVENTION

The present invention addresses the aforementioned need by providing an infant rocker/cradle for use on a generally flat support surface which can be used to both rock and cradle an infant. The infant rocker/cradle includes a generally rectangular frame having two generally parallel, opposing and spaced sides. The sides are joined to each other by two generally parallel, opposing and spaced ends which join the sides of the frame at right angles. Each side defines a first arcuate rocking edge which is parallel to that defined by the other side. Similarly, each end defines a second arcuate rocking edge which is parallel to that defined by the other end. The first and second arcuate rocking edges are oriented with respect to each other so that they generally face opposite directions and are generally disposed at right angles with respect to each other.

The infant rocker/cradle of the present invention also includes infant support means, preferably a hammock, which is attached to the frame within the frames' ends and sides. The infant support means is capable of supporting an infant when the infant rocker/cradle is lying on a generally flat support surface with either the first or second arcuate rocking edges in contact with the flat support surface.

To rock an infant in the infant rocker/cradle, one locates the rocker/cradle on a floor or support surface which is preferably flat with the rocker/cradle's first arcuate rocking edges in contact with the floor. This position of the cradle/rocker is referred to herein as the rocker or rocking position. One then places the infant on the infant support means of the rocker/cradle with the infant's head and feet respectively positioned at or near the frame's opposing ends. The infant can then be rocked by grasping any portion of the cradle and rocking the rocker/cradle on its first arcuate rocking edges.

To cradle an infant (i.e. rock an infant laterally, from side to side), one turns the rocker/cradle upside down so that the rocker/cradle's second arcuate rocking edges defined by the ends of the rocker/cradle are in contact with the floor or support surface. This position is referred to herein as the cradle or cradling position. One then places the infant on the infant support means with the infant's head and feet respectively positioned at or near the frame's opposing ends. One then cradles the infant by grasping the rocker/cradle and rocking the cradle so that it rocks back and forth on its second arcuate edges.

In view of the above, it will be appreciated that by turning the rocker/cradle upside down one can switch from the rocking position to the cradling position and vice versa. It will also be appreciated that the infant support means is capable of supporting an infant when the rocker/cradle is in either position.

In a preferred embodiment, the infant rocker/cradle includes stop means for preventing the rocker/cradle from tipping over when it is in either the rocking or cradling position. In a more preferred embodiment of the invention, the stop means is defined by edges of the rocker/cradle's sides and ends which are dimensioned to prevent the rocker/cradle from tipping over when the rocker/cradle is in either the rocking or cradling position.

In another preferred embodiment of the present invention, the infant support means includes a rectangular section of generally washable, material such as a hammock which attaches to the inner facing surfaces of the frames' sides and ends. The hammock is preferably attached to the inner facing surfaces of the frames' sides and ends by a plurality of longitudinally extending rods, each of which is attached at its midsection to one of the inner facing surfaces of the frames' sides and ends so that each rod has two exposed free ends. The attaching means further includes a plurality of loop pairs attached to the hammock's peripheral edge. Each loop pair has two axially aligned loops which are sized, configured and spaced from each other to receive the exposed free ends of one of the rods. As such, one free end of a rod is receivable in one loop of a loop pair while the other free end of the rod is receivable in the other loop of the loop pair. The loops are preferably made of a resilient material so that the loops can be easily looped over and removed from a rod's free end. As such, the hammock can be easily removed from the frame of the infant rocker/cradle so that it can be washed. In yet a further preferred embodiment, the infant rocker/cradle of the present invention is collapsible so that it is easier to handle and store.

BEST MODE FOR CARRYING OUT THE INVENTION

Figure 1:
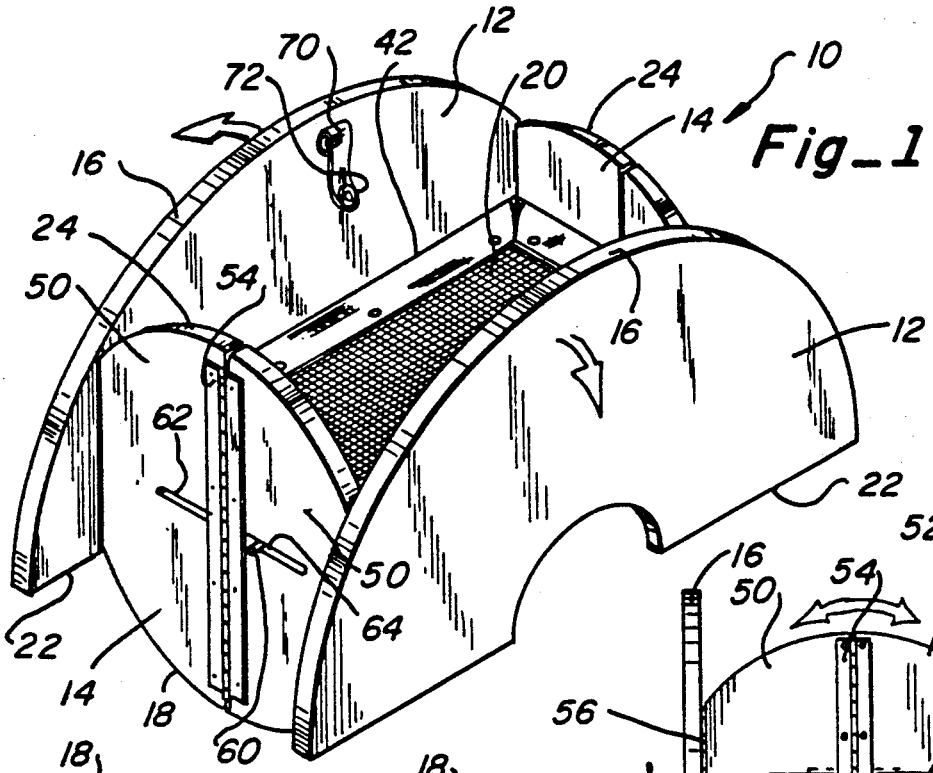
FIG. 1 is a perspective view of a rocker/cradle of the present invention showing the rocker/cradle in its cradling position.

FIGS. 1 through 10 disclose a device 10 referred to herein as rocker/cradle 10 for rocking and cradling an infant. The rocker/cradle has a generally rectangular frame (not numbered) with two generally parallel, opposing and spaced sides 12 which are joined to each other by two generally parallel, opposing and spaced ends 14. As illustrated, ends 14 join sides 12 at right angles.

In accordance with an important aspect of the present invention, sides 12 define arcuate rocking edges 16 (referred to herein as first arcuate rocking edges 16) which, as illustrated, are parallel to each other. Similarly, ends 14 define arcuate rocking edges 18 (referred to herein as second arcuate rocking edges 18) which are also parallel to each other. Edges 16 and 18 are oriented with respect to each other so that they face opposite directions and are disposed at right angles with respect to each other.

As also illustrated in the drawings, the rocker/cradle 10 of the present invention includes a hammock 20 (also referred to herein as infant support means) which is attached to the inner facing surfaces (not numbered) of the rocker/cradle's sides 12 and ends 14. As will be understood from the description which follows, hammock 20 is capable of supporting an infant placed on either side of the hammock, i.e. when the rocker/cradle is positioned with either its first or its second arcuate rocking edges in contact with a floor, such as floor 21 illustrated in FIGS. 2 and 4 or any other generally flat support surface. For ease of description purposes, rocker/cradle 10 will be described as being in its cradling position when the second arcuate rocking edges 18 are in contact with floor 21 and in its rocking position when first arcuate edges 16 are in contact with floor 21 or another generally flat support surface.

Rocker/cradle 10 also includes stop means or stop edges 22 and 24 for preventing the rocker/cradle from tipping over when it is in either its rocker or cradling position. Stop edges 22 which are defined by sides 12 will prevent or at least inhibit the rocker/cradle from tipping over when the rocker/cradle is in its cradling position (see FIG. 2). Similarly, in FIG. 4 it can be visualized that stop edges 24 of each 14 will prevent or at least inhibit the rocker/cradle from tipping over when the rocker/cradle is rocked on edges 16, (i.e. its rocking position).

Figure 5:
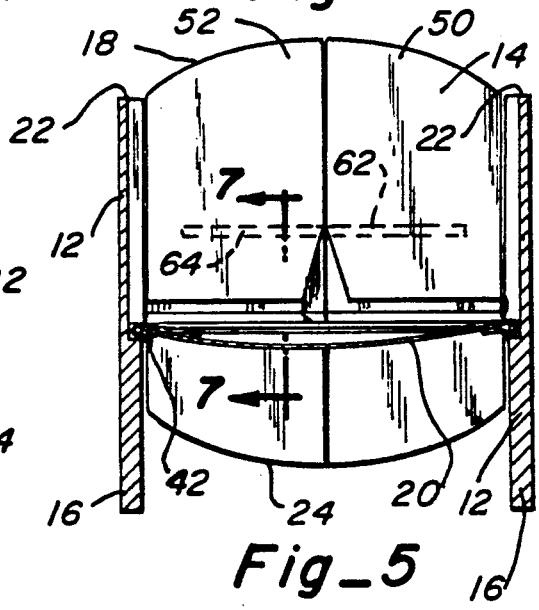
FIG. 5 is a cross sectional view taken along lines 5—5 of FIG. 4.
Figure 6:
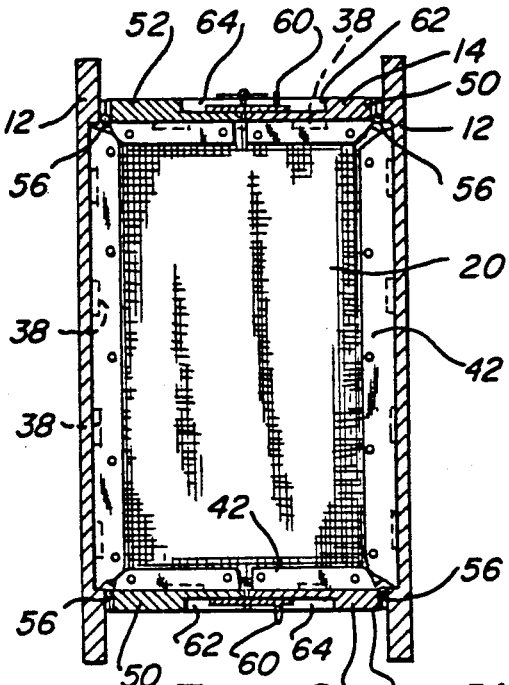
FIG. 6 is a cross sectional view taken along lines 6—6 FIG. 2.
Figure 9:
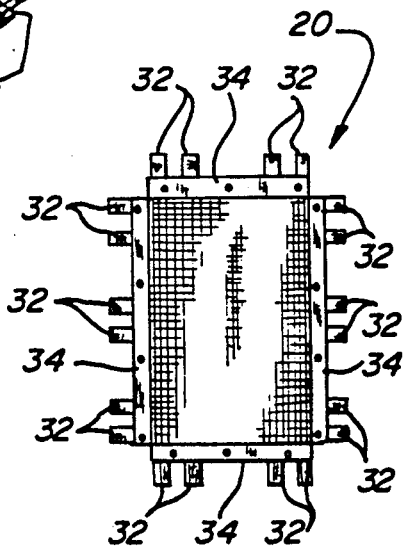
FIG. 9 is a plan view showing the hammock of FIG. 1 in isolation.

Hammock 20 of the present invention is best illustrated in FIGS. 5, 6 and 9. In the cross sectional view of FIG. 5, it can be seen that hammock 20 sags slightly across its midsection as any hammock does due to the action of gravity. The amount of any sagging will also, of course, depend upon the type of material hammock 20 is made from. In the illustrated embodiment, hammock 20 is made from a washable cloth fabric such as cotton. Hammock 20 can also be made from firmer and more resilient material such as leather, rubber and possibly certain synthetic materials. Hammock 20 could also be replaced with a rigid support means such as a wooden board or some sort of support made from a rigid wooden composite or plastic. However, such a rigid support means would also most likely require the use of some sort of mattress to cushion an infant from the hard surface. A rigid support means would also have to be removed from the rocker/cradle prior to collapsing the rocker/cradle as will be explained in more detail below.

Figure 7:
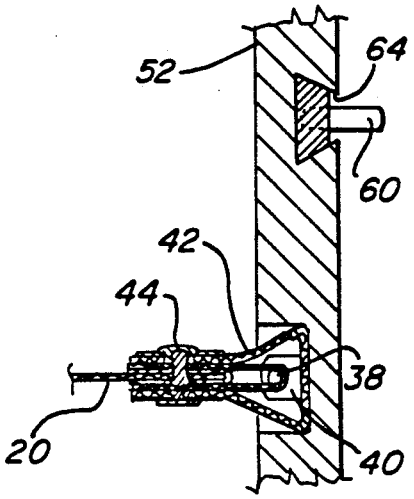
FIG. 7 is a partial cross sectional view taken along lines 7—7 of FIG. 5.
Figure 8:
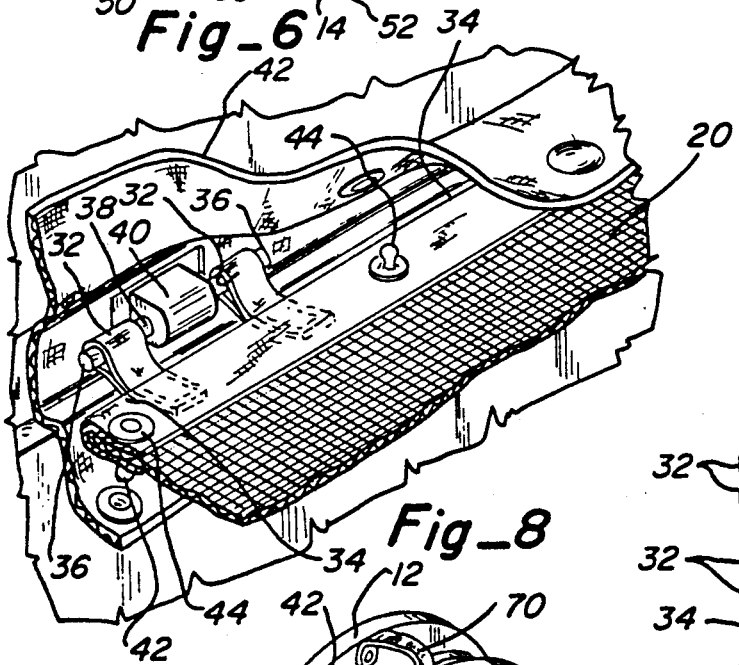
FIG. 8 is a partially broken away, perspective view showing a preferred means for attaching the rocker/-cradle's hammock to the inner facing surfaces of the rocker/cradle of FIG. 1.

FIG. 9 illustrates hammock 20 in isolation wherein it can be seen that it is provided with a plurality of pairs of loops 32 about its peripheral edge 34. Loops 32 are provided to secure the hammock to the inner facing surfaces (not numbered) of the rocker/cradle's sides and ends. As illustrated in FIGS. 7 and 8, loops 32 of each loop pair (not numbered) secure the hammock to rocker/cradle 10 when they are looped over the free ends 36 of a rod 38 which is attached at its midsection 40 to one of the inner facing surfaces of the rocker/cradle's sides or ends. To facilitate looping and removal of loops 32 over free ends 36 of rod 38, loops 32 are preferably made from a sturdy but flexible material such as heavy cotton cloth or leather. Loops 32 of each loop pair are also axially aligned, sized, configured and spaced from one another so that they are easily looped over and easily removed from free ends 36. From FIGS. 6 and 9, it will be appreciated that a plurality of properly spaced and located rods 38 are provided along the inner facing surfaces of the rocker/cradle's sides and ends so that the hammock can be securely attached to the rocker/cradle and yet easily removed therefrom. Those skilled in the art will also appreciate that the aforementioned loop and rod attaching means securely attaches the hammock to the rocker/cradle no matter which side of the hammock is supporting the infant.

FIGS. 7 and 8 illustrate that the rocker/cradle 10 is also provided with a protective flap 42 which is attached to the inner facing surfaces of the rocker/cradle's ends and sides and which is foldable over and snapable onto snaps 44 provided along the peripheral edge of both sides of the hammock. When buttoned or snapped to the hammock, flap 42 serves to prevent an infant from getting pinched by loops 32 and rods 38 and possibly from getting an arm or a leg caught between the peripheral edge of the hammock and the rocker/cradle's side or end walls.

Figure 2:
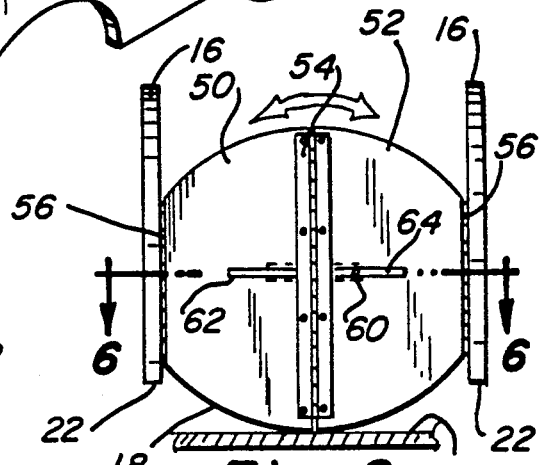
FIG. 2 is an end view of the rocker/cradle of FIG. 1.
Figure 10:
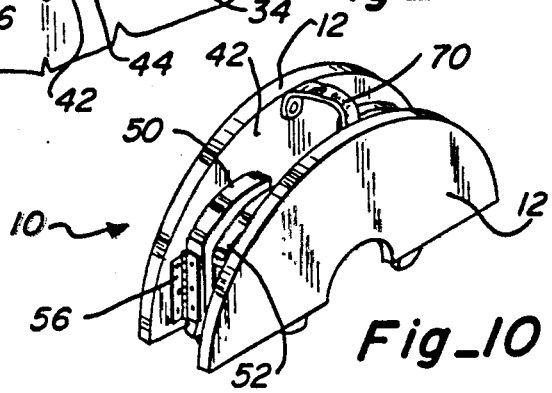
FIG. 10 is a perspective view showing the rocker/-cradle of FIG. 1 in its collapsed position.

Rocker/cradle 10 of the present invention is also preferably collapsible for ease of handling and storing. To make rocker/cradle 10 collapsible, each end 14 comprises two symmetrical end sections 50 and 52 which are hinged together by a hinge 54 along the outer facing surfaces of the adjoining edges of sections 50 and 52, as illustrated in FIG. 2. Each end section is also hinged to the wall of its adjoining side 12 by a hinge 56 as illustrated in FIG. 10. These hinges enable the end sections of each end 14 to be inwardly collapsed towards those of the other end as such is illustrated in FIG. 10.

To prevent the rocker/cradle from collapsing during use, each end also includes a locking means (not numbered) for preventing the end sections from being inwardly collapsed. As illustrated in FIG. 2, the rocking means includes a slide bar 60 which is slidably received in a pair of aligned groves 62, 64 which are provided, respectively, in end sections 50 and 52. The bar is in its locked position preventing end sections for inwardly collapsing when it is partially located in both grooves. When slid completely to the right so that it is entirely located in one groove, end sections 50 and 52 will be unlocked and thereby free to collapse inwardly.

FIG. 10 illustrates rocker/cradle 10 in its collapsed position. FIG. 10 also illustrates that the rocker/cradle is provided with a strap 70 which serves as a handle for carrying the rocker/cradle when it is in its collapsed position. Strap 70, as illustrated, has one end secured to one side of the rocker/cradle. The strap's other end (not numbered) is provided with a snap 72 which is snapped onto a snap button (not shown) which is attached to the other side of the rocker/cradle. As such, rocker/cradle 10 is provided with a convenient handle for carrying the rocker/cradle 10 in its collapsed position.

Figure 4:
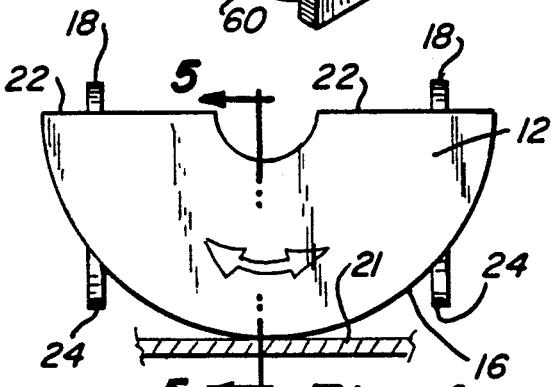
FIG. 4 is a side elevation view of the rocker/cradle of FIG. 3.
Figure 3:
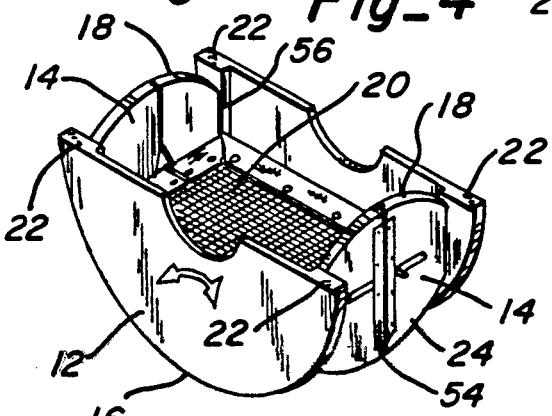
FIG. 3 is a perspective view of the rocker/cradle of FIG. 1 turned upside down so that it is in its rocking position

In view of the aforementioned description, those skilled in the relevant art will appreciate that the present invention provides an infant rocker/cradle which can be used to either rock or cradle an infant. To rock an infant in the lengthwise direction, i.e. from head to toe, one locates the rocker/cradle on a preferably flat surface with the rocker/cradle's sides or first arcuate edges 16 in contact with the floor, as illustrated in FIG. 4. As previously mentioned, this position of the rocker/cradle is referred to herein as the rocker or rocking position. To rock an infant, one places an infant on the hammock with the infant's head and feet respectively positioned near ends 14. The infant can then rocked by grasping any portion of the rocker/cradle and rocking it so that the rocker/cradle rocks on edges 16.

To cradle an infant, i.e. rock an infant laterally from side to side, one turns the rocker/cradle upside down so that the end's arcuate rocking edges 18 are in contact with the floor. As previously mentioned, this position is referred to as the cradling position. One then places the infant on the hammock with the infant's head and feet positioned near ends 14 of the rocker/cradle. One then cradles the infant, i.e. gently rocks the infant laterally from side to side by grasping any portion of the rocker/cradle and rocking the cradle so that the rocker/cradle rocks back and forth on edges 18.

The invention has been described in detail with reference to a particular embodiment thereof, but will be understood that various other modifications can be effected within the spirit and scope of the invention.

What is claimed:

1. A device for use on a generally flat surface to rock and cradle an infant comprising:

a generally rectangular frame having two generally parallel, opposing and spaced sides which are joined to each other by two generally parallel, opposing and spaced ends which join said sides at generally right angles, each side defining a first arcuate rocking edge which is parallel to that defined by the other side, each end defining a second arcuate rocking edge which is parallel to that defined by the other end, said first and second arcuate rocking edges also being oriented with respect to each other so that they generally face opposite directions and are generally disposed at right angles with respect to each other; and infant support means attached to said frame within said ends and said sides for supporting an infant when either said first or said second arcuate rocking edges are in contact with the generally flat surface.

2. A device as claimed in claim 1 further comprising:

stop means for preventing said device from tipping over when either said first or said second arcuate rocking edges are in contact with the generally flat surface.

3. A device as claimed in claim 2 wherein said stop means includes stop edges which are edges of said sides and ends that are defined by said sides and said ends to prevent said device from tipping over when either said first or second arcuate rocking edges are in contact with the generally flat surface.

4. A device as claimed in claim 1 wherein said infant support means includes resilient material for supporting an infant when either said first or second arcuate rocking edges are in contact with the generally flat surface.

5. A device as claimed in claim 4 further comprising attaching means for securing a rectangular section of said resilient material to the inner facing surfaces of said sides and said ends of said frame.

6. A device as claimed in claim 5 wherein said attaching means includes:

a plurality of longitudinally extending rods, each of which is attached at its midsection to one of said inner facing surfaces of said frame's sides and ends so that each rod has two free ends; and a plurality of loop pairs attached along the peripheral edge of said rectangular section of resilient material wherein each loop pair has two axially aligned loops which are sized, configured and spaced from each other to receive the free ends of one of said rods so that one free end of a rod is receivable in one loop of a loop pair while the other free end of the rod is receivable in the other loop of the loop pair, said loops being made of a resilient material so that they are easily looped over and removed from the free ends of a rod.

7. A device as claimed in claim 6 wherein said resilient material is made from a cloth fabric.

8. A device as claimed in claim 7 wherein said resilient material is a resilient washable fabric.

9. A device as claimed in claim which is collapsible.

10. A device as claimed in claim 9 wherein each of said ends includes two symmetrical end sections which are hinged together along the outer facing surfaces of the sections so that said end sections are capable of collapsing inwardly towards said end sections of said other end to enable said device to be collapsed.

11. A device as claimed in claim 10 wherein each end includes locking means for preventing said end sections from being inwardly collapsed and for permitting said end sections to be inwardly collapsed when said locking means are in an unlocked position.

12. A device as claimed in claim 9 further comprising securing means for maintaining said device in a collapsed position to facilitate handling and storage of said device.

* * * * *